United States Patent [19]

Fuchs

[11] Patent Number: 4,789,433

[45] Date of Patent: Dec. 6, 1988

[54] SKIMMING BLADE WITH WAVE SHAPED TROUGHS FOR A PAPERMAKING MACHINE

[75] Inventor: Karl-Dieter Fuchs, Ebersbach/Fils, Fed. Rep. of Germany

[73] Assignee: Feldmuehle Aktiengesellschaft, Duesseldorf, Fed. Rep. of Germany

[21] Appl. No.: 7,909

[22] PCT Filed: Apr. 11, 1986

[86] PCT No.: PCT/DE86/00158

§ 371 Date: Oct. 31, 1986

§ 102(e) Date: Oct. 31, 1986

[87] PCT Pub. No.: WO86/06117

PCT Pub. Date: Oct. 23, 1986

[30] Foreign Application Priority Data

Apr. 13, 1985 [DE] Fed. Rep. of Germany ..... 3513320

[51] Int. Cl.[4] ..... D21F 1/54; D21F 1/48

[52] U.S. Cl. ..... 162/352; 162/374

[58] Field of Search ..... 162/352, 374

[56] References Cited

U.S. PATENT DOCUMENTS

| | | | |
|---|---|---|---|
| 3,496,064 | 2/1970 | Scott | 162/374 |
| 3,573,159 | 3/1971 | Sepall | 162/352 |
| 4,123,322 | 10/1978 | Hoult | 162/352 |

FOREIGN PATENT DOCUMENTS

| | | | |
|---|---|---|---|
| 699193 | 12/1964 | Canada | 162/352 |
| 0078406 | 5/1983 | European Pat. Off. . | |
| 2337676 | 2/1974 | Fed. Rep. of Germany . | |
| 3316708 | 12/1983 | Fed. Rep. of Germany . | |
| 2012871 | 3/1970 | France | 162/352 |
| 2113264 | 8/1983 | United Kingdom . | |

*Primary Examiner*—David L. Lacey
*Assistant Examiner*—K. M. Hastings
*Attorney, Agent, or Firm*—Felfe & Lynch

[57] ABSTRACT

Skimming blades in papermaking machines have a dewatering surface 4 adjoining the supporting surface 3 supporting the wire 1. To sustain the desired microturbulence of the fiber suspension 2 on the wire 1, the dewatering surface 4 is provided with troughs 7. The troughs 7 have a wavy shape, in which the wave crests 5 have a smaller radius r than the wave valleys 6.

13 Claims, 4 Drawing Sheets

SKIMMING BLADE WITH WAVE SHAPED TROUGHS FOR A PAPERMAKING MACHINE

The invention relates to a skimming blade for a papermaking machine for the removal of water from the pulp on the wire of the papermaking machine. The skimming blade has a supporting surface disposed substantially parallel to the wire and supporting the wire, and the supporting surface is adjoined by at least one dewatering surface serving for dewatering by suction and offset from the supporting surface.

Skimming blades, which are also called "foils," have long been commonly used components in papermaking machines; they are distinguished from register rolls by a very high dewatering rate, i.e., the use of foils in papermaking machines has considerably reduced the sheet formation length of the wet end of such machines. In other cases it has been possible by installing foils to increase the rate of production of the machine without changing the sheet formation length of the wet end.

High dewatering rates, however, lead to considerable problems in sheet forming, i.e., at the usual consistencies of the fiber suspension, the fibers and fillers tend to flocculate coarsely. To reduce this flocculation, high-turbulence headboxes have been developed, which provide a well-distributed fiber suspension onto the wire of the papermaking machine with a highly uniform microturbulence.

This turbulence of the furnish decreases again after a relatively short time as it runs onto the papermaking machine wire, the term, "short time," meaning a range of a few milliseconds, i.e., after a wire travel of 20 to 100 cm there is no microturbulence in the fiber suspension to prevent the flocculation of fillers and of fibers. The turbulence itself can be imagined as an accumulation of small eddies, the life of an eddy being shorter as the eddy is smaller.

The production of large eddies is undesirable since, due to the centrifugal forces, they cause separation which in turn leads to poorer sheet formation. As these considerations show, the microturbulence of the fiber suspension provided by the high-turbulence headboxes has already substantially subsided before the suspension reaches the first skimming blade, e.g., the first forming board blade or foil blade.

In DE-A No: 23 37 676, therefore, it has already been proposed to provide a skimming blade with a trough within the bearing area, which is to form a stirring channel. The effect thereby achieved is only very slight, however, since the trough once filled with water is substantially neutral in behaviour, and the wire, which is in contact with both sides of the wire supporting area of the foil blade, seals off the trough once it has been filled with water. The minimal entrainment of water caused by the moving wire is not sufficient to create any microturbulence in the furnish on the wire that would reach as far as the dewatering surface of the foil.

It is therefore the object of the invention to create a skimming blade for a papermaking machine, which will make it possible to sustain the microturbulence within the fiber suspension on the wire, and to control and revive the microturbulence.

This object is achieved by a skimming blade for a papermaking machine for dewatering the furnish on the wire of the papermaking machine, which has a bearing surface supporting the wire and disposed substantially parallel to the wire, the bearing surface being adjoined by at least one dewatering surface serving for dewatering by vacuum and offset from the bearing surface, and which has the distinguishing characteristic that the dewatering surface has at least one trough which extends along the envelope line of the dewatering surface at an angle of 90 to 5 degrees from the direction of movement of the wire.

The offsetting of the dewatering surface from the bearing surface of a foil is disclosed in DE-A No. 24 18 851. The step formed between the the bearing surface and the dewatering surface can apply a suction to the wire, this suction being controllable. The dewatering rate is thus controllable. The good sheet formation based on microturbulence, however, can hardly be affected by controlling the vacuum. Only by disposing a trough in the area of the dewatering surface, and not letting it be blocked by the wire, can any change be produced in the flow, i.e., a portion of the water sucked through the wire is driven back by the flow, again passes through the wire, and the fiber suspension on the wire is set in motion, i.e., fibers and filler particles are moved upwardly thus creating a microturbulence. By the pulling and pushing actions, but preferably by the pushing actions, turbulent forces are to be produced in the fiber suspension, such as those known to be produced by the front edges of skimming blades. The magnitude of the pushing or pulling forces is what determines the spectural distribution and hence the size of the eddies in the fiber suspension.

The term, "trough," as used in the present application, is to be understood to mean a recess extending over at least a part of the cross section of the dewatering surface, which in itself can be of any desired configuration. However, the trough can advantageously have a triangular or trapezoidal cross section, though other polygons are also conceivable. According to a preferred development of the invention, the cross section of the trough is wavy, i.e., the trough is defined by radii. The trough depth can be best be between 2.5 and 70% of the foil thickness in this area, i.e., in the area of the dewatering surface.

The wavy cross section of the trough immediately gives two advantages. On the one hand the wave shape results in a gentler transition in the cross-sectional variation of the foil, which is a very important point in the manufacture of ceramic foils, since abrupt cross-sectional changes can result in uneven distribution of material and thus easily in tension cracking even during manufacture, i.e., when the ceramic powder is being compressed, and in the sintering process that follows, but even in the case of the completed article temperature changes can result in tension cracking precisely in the area of the abrupt change in cross section.

The supporting surface of the foil is commonly polished, i.e., it has an average roughness value Ra between 0.1 and 0.2 of a micrometer, but should preferably be less than 0.1 of a micrometer. The adjoining dewatering surface is not polished but, according to a preferred embodiment of the invention, is only roughly ground, so as to produce Ra values between 0.5 and 10.0 micrometers. The rough surface structure that is thus established causes a certain fine microturbulence in the boundary surface area of the furnish if the wire of the papermaking machine is running at speeds of more than 150 meters per minute.

According to an advantageous embodiment of the invention, the radii of the waves forming the cross section of the trough vary, the radius r of the wave peak being smaller than the radius R of the valley. It is best for the radius r of the wave peaks to be between 0.05 and 20 mm, and the radius R of the valleys between 0.1 and 50 mm. At this time it is not yet fully understood why it is that the selection of a smaller radius r for the wave peak achieves a better microturbulence than if the opposite is the case. Probably the formation of tubulence is based on the laws of aerodynamics in the case of the swept airfoil, i.e., the flow rolls upwardly in the back of the airfoil. Results show, however, that sheet formation is thereby improved.

According to a preferred embodiment of the invention, the distance between the individual troughs increases in the direction of movement of the wire, the radii of the wave peak and of the wave valley advantageously increasing in size in the direction of movement of the wire. If, as already stated, turbulence is conceived to be a congeries of eddies, the smaller the eddy is, the shorter its life will be. By enlarging these eddies at the end of the dewatering area, a certain microturbulence will persist furnish on the wire betwee the end of the dewatering area and the beginning of the next supporting surface of the following foil. The depth of the troughs and their distance from one another thus depends on the distance between the foils. The greater the distance between the individual skimming blades is, the greater the radii must be.

In the case of skimming blades such as foils, for example, two kinds are known which are entirely different from one another, namely the single foil with a width between 80 and 150 mm, and multifoils made of single blades with a width of 30 to a maximum of 65 mm each with a distance between them of usually one to four times their width. In the case of single foils, the distance between two single foils is 200 mm or more. The term, "width," in this connection refers to the dimension of the foil in the direction of wire travel. The width of the dewatering surface of the foil is usually greater than the width of the supporting surface. According to an advantageous development of the invention, the width of the dewatering surface amounts to 3 to 30 times the width of the supporting surface. The smaller widths are to be associated with the multifoils, the larger with the single foils, i.e., the single foil can accommodate more and larger troughs whose distance apart can best be equal to or greater than 5 times the radius r of the wave crest.

According to an advantageous development of the invention, the dewatering surface is inclined from the supporting surface at an angle of 5 to 360 minutes. This angle is measured between an envelope line connecting the apexes of the trough, and a line imagined as a prolongation of the supporting surface of the skimming blade. The latter line is the theoretical line of travel of the papermaking machine wire, but in practice the wire is drawn downwardly by gravity and by the suction building up behind the bearing surface, i.e., toward the dewatering surface, so that the wire always droops between two skimming blades.

A preferred embodiment of the invention provides that between the bearing surface and an envelope line drawn over the apexes of the troughs there is an empty space whose depth amounts to 0.1 to 10.0 mm.

Skimming blades whose dewatering surface is a step below the supporting surface are disclosed in German Federal Patent No. 24 18 851. In this design the dewatering is performed substantially by the application of a vacuum, i.e., the suction is not created by the configuration of the foil but the foil is in this case disposed on a suction box from which air is extracted by appropriate means such as a vacuum pump or down pipe. In this design, too, any microturbulence present on the wire fades away completely just a short distance in back of the supporting surface. The arrangement of troughs in the area of the stepped dewatering surface produces even in this known design a substantial improvement of the sheet forming, if the depth of the free space between the wire and envelope line defined in the claim is maintained.

According to an additional advantageous embodiment of the invention, the envelope line can be a curve, this curve running parallel to the screen or diverging slightly therefrom.

An advantageous development of the invention provides that a step is formed between the bearing surface and the dewatering surface by a convex-concave arc which merges with the waves of the troughs.

The various features of novelty which characterize the invention are pointed out with particularity in the claims annexed to and forming a part of the specification. For a better understanding of the invention, its operating advantages and specific objects obtained by its use, reference should be had to the accompanying drawings and descriptive matter in which there is illustrated and described a preferred embodiment of the invention.

BRIEF DESCRIPTION OF THE DRAWINGS

FIG. 1 shows a skimming blade with two bearing surfaces 3 separated from one another by a trough 7. The wire 1, on which the fiber suspension 2 is borne, slides across the bearing surfaces 3. In this skimming blade which is the state of the art, it was assumed that, on the basis of the vacuum created at the beginning of the trough 7, water is sucked out of the fiber suspension 2 into the trough 7 and is then forced back through the wire 1 and thus provides for an agitation of the fibers 12 in the fiber slurry 2 on top of the wire 1 in the back of the trough 7.

Figure 1:
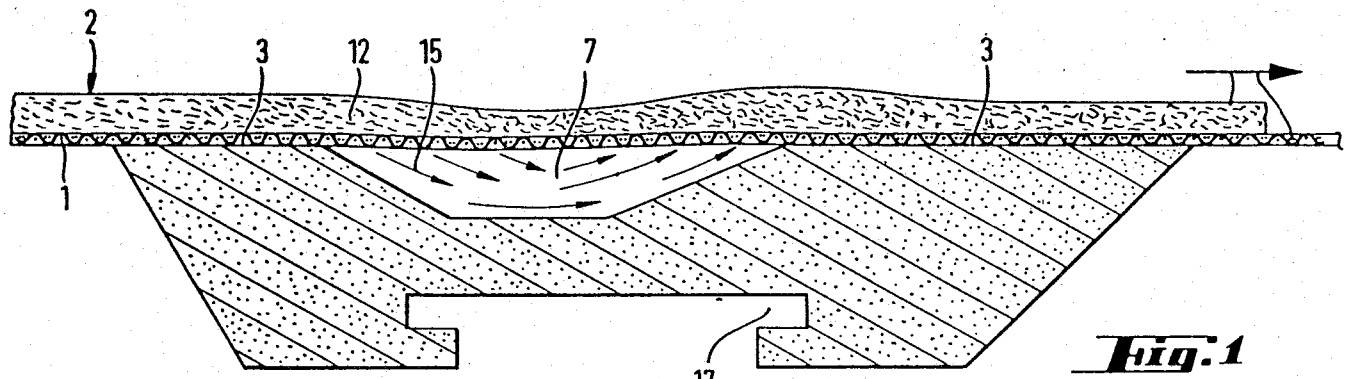
Fig. 1 PRIOR ART
FIGS. 1 and 2 show a side view of a foil according to the state of the art.
Figure 2:
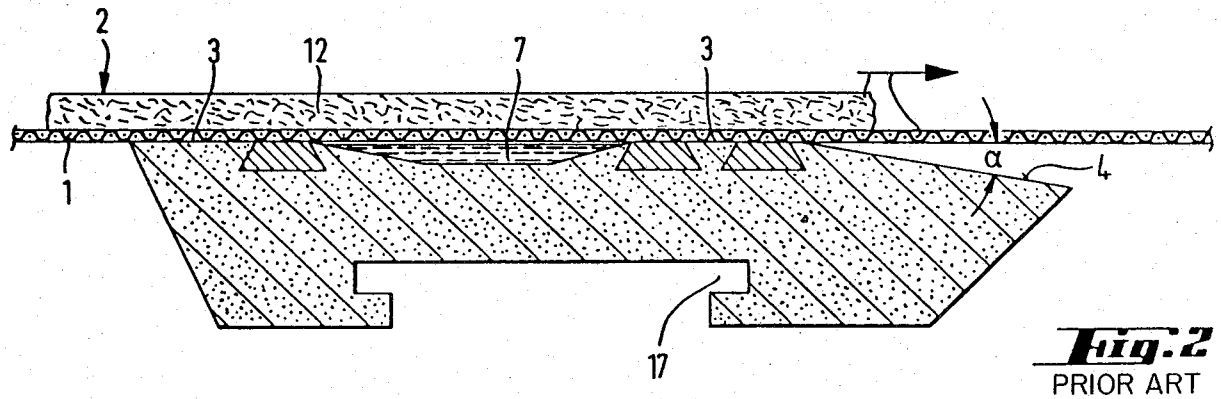
Fig. 2 PRIOR ART

But once the trough 7 fills with water, a vacuum cannot form again under the wire 1 in the area of the trough 7, but instead, aside from slight losses of water, a quieted zone forms in the area of the trough 7. The trough 7 thus provides at best a lubricating function, but does not contribute to the formation of a microturbulence; this situation is represented in FIG. 2.

Figure 3:
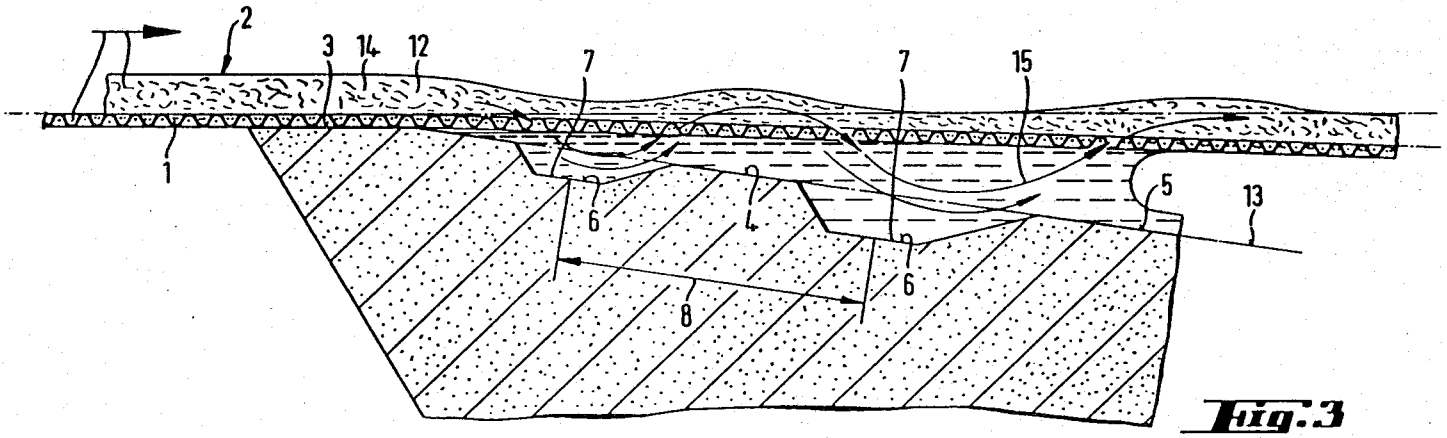
FIG. 3 shows a foil having trapezoidal troughs, FIG. 4 a foil with triangular troughs, FIG. 5 a foil with step and arcuate envelope line, FIG. 6 a foil with step and rectilinear envelope line, FIG. 7 a foil with step and bent envelope line.
Figure 4:
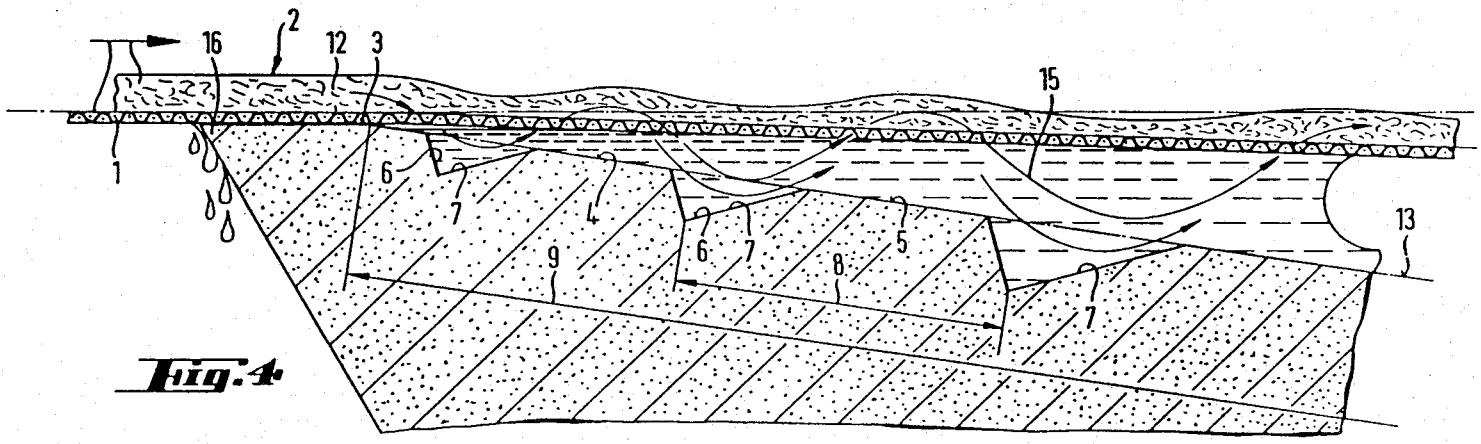

In FIG. 3 there is shown a foil whose troughs 7 are of trapezoidal shape, and the angle at which the envelope line 13 runs is considerably enlarged. The shorter side of the trapezoid is the side adjacent the supporting surface 3 and it forms a steeper angle with the wire than the opposite side of the trapezoid, which is longer, and which, due to the suction created, deflects part of the water that passes through the wire 1 away from the dewatering surface 4 and back upwardly through the wire into the fiber suspension where it produces the stirring up of the fibers 12 and pigments 14. The arrows 15 indicate the direction of flow of the water. Of course, not all of the water returns through the wire 1 into the fiber slurry 2; instead most of it is removed and flows downwardly in the rear area of the dewatering surface 4. Another part is skimmed off from the screen 1 by the leading edge 16 of the following foil.

The distance 8 between the individual troughs, which is measured from the lowermost point of the trough 7, or, if the trough 7 is horizontal, from the center of the trough floor to the center of the following trough arc, increases in the direction of wire movement, and the depth of the troughs also increases.

In all the drawings, the dewatering surface 4 is shown as being provided with troughs 7 over its entire width. It is also possible, however, to dispose these troughs only in the rearward area, i.e., in the area of the dewatering surface 4 farthest from the bearing surface 3.

Figure 5:
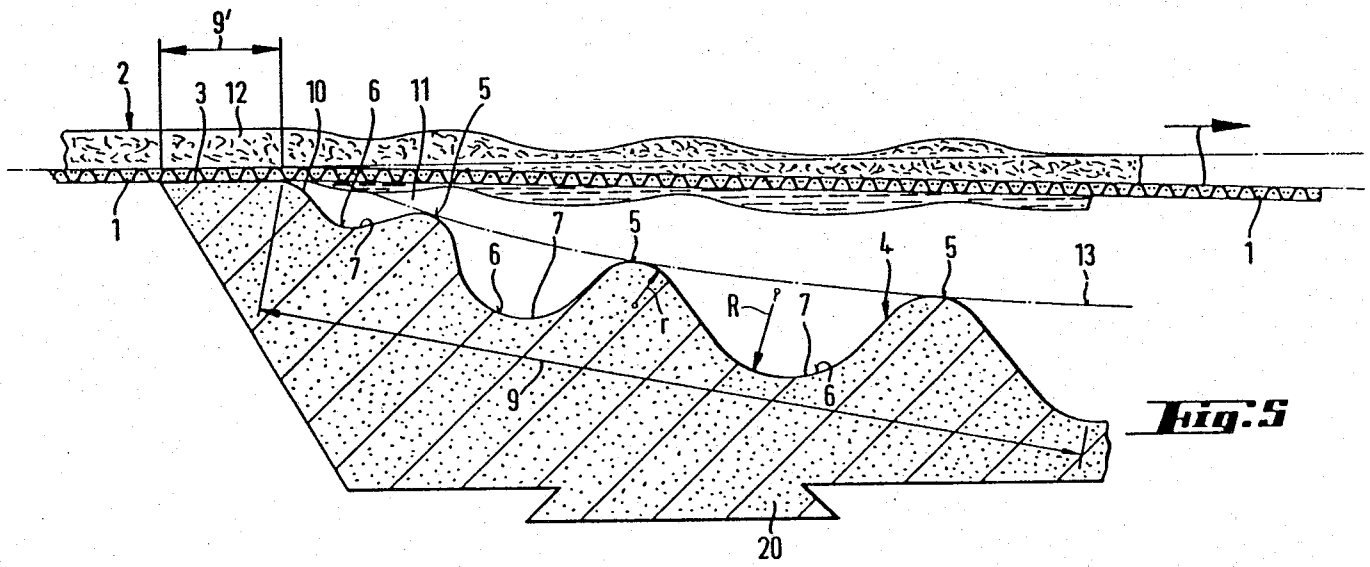
Figure 6:
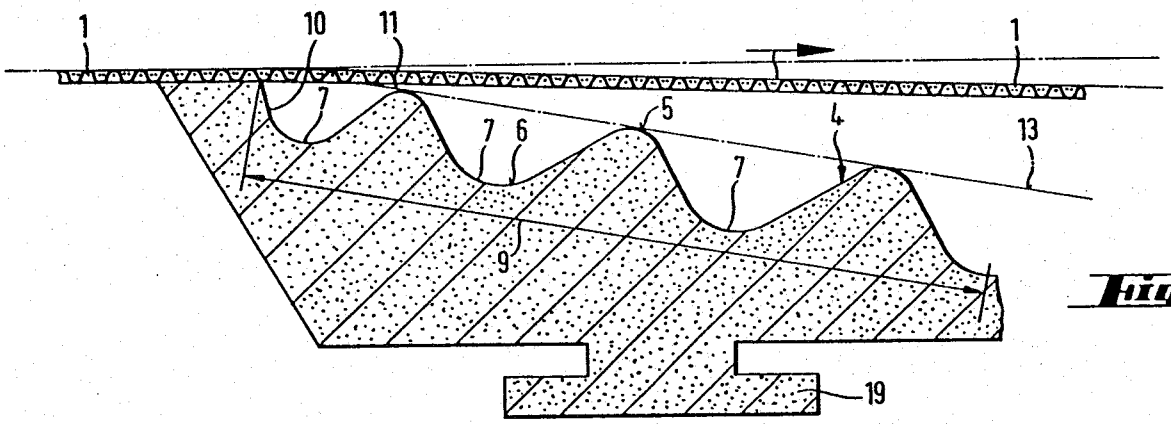
Figure 7:
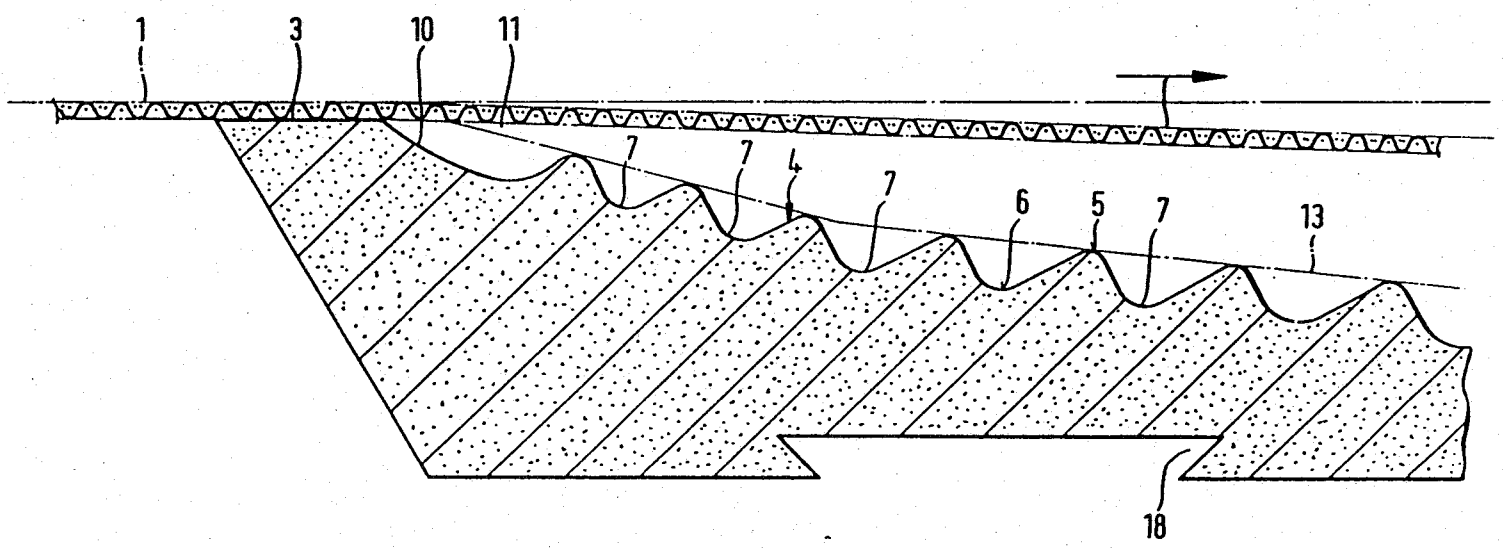

FIGS. 5 and 6 show between the bearing surface 3 and the envelope line 13 a step 10 which is S-shaped in FIG. 5 and passes directly into the wave valley 6 and from there passes into the wave crest of the first trough 7. This step 10 forms between the envelope line 13 and wire 1 a free space in the supporting surface area 3, in which the vacuum produced by a vacuum pump or by down pipes is applied.

For mounting, the skimming blades are equipped with T-slots 17, dovetail slots 18, T-rails 19 or dovetail rails 20.

It will be understood that the specification is illustrative but not limitative of the present invention and that other embodiments within the spirit and scope of the invention will suggest themselves to those skill in the art.

I claim:

1. A skimming blade for removing water from a fiber slurry on a moving wire, having a direction of travel, of a papermaking machine, comprising a blade having a supporting surface to support the wire and run substantially paprallel to the wire, which is adjoined by at least one dewatering surface serving for vacuum dewatering, said dewatering surface being inclined with respect to the supporting surface by an angle of 5 to 360 minutes and having a plurality of troughs which extend at an angle of 90 to 5 degrees to an imaginary extension line of the supporting surface at a level of an envelope line of the dewatering surface without passing downward through the skimming blade.

2. The skimming blade of claim 1 wherein the dewatering surface has an Ra value of from 0.5 to 10.0 micrometers.

3. The skimming blade of claim 1 wherein each of the plurality of troughs has a cross section having a wave shape.

4. The skimming blade of claim 3 wherein the wave shape cross section has wave crests of a radius r and wave valleys of a radius R, the radius r of the wave crests being smaller than the radius R of the wave valleys.

5. The skimming blade of claim 4 wherein r is from 0.5 to 20 mm and R is from 1 to 50 mm.

6. The skimming blade of claim 4 wherein the distance between two adjacent troughs is equal to or greater than five times r of the wave crests.

7. The skimming blade of claim 4 wherein r of the wave crest and/or R of the wave valley increase in size in the direction of wire travel.

8. The skimming blade of claim 3 wherein a convex-concave curve, which merges with the waves of the plurality of troughs, forms a step between the supporting surface and the dewatering surface.

9. The skimming blade of claim 1 wherein the distance between individual adjacent troughs increases in the direction of wire travel.

10. The skimming blade of claim 1 wherein the dewatering surface has a width which amounts to three to twenty times that of the supporting surface.

11. The skimming blade of claim 1 wherein between the supporting surface and the envelope line drawn across the apexes of the troughs, there is a free space of a height of from 0.1 to 10 mm.

12. The skimming blade of claim 11 wherein the envelope line is a curve.

13. The skimming blade of claim 11 wherein each of the plurality of troughs has a depth of 2.5% to 70% of the thickness of the skimming blade in the area of the dewatering surface.

* * * * *

UNITED STATES PATENT AND TRADEMARK OFFICE

CERTIFICATE OF CORRECTION

PATENT NO. : 4,789,433

DATED : December 6, 1988

INVENTOR(S) : Karl-Dieter Fuchs

It is certified that error appears in the above-identified patent and that said Letters Patent is hereby corrected as shown below:

Column 3, line 2, "0.05" should read -- 0.5 --.

Column 3, line 3, "0.1" should read -- 1.0 --.

Column 3, line 21, "persist furnish" should read -- persist in the furnish --.

Column 3, line 21, "betwee" should read -- between --.

Column 6, line 39 "11" should read -- 1 --.

Signed and Sealed this

Seventh Day of August, 1990

*Attest:*

HARRY F. MANBECK, JR.

*Attesting Officer*

*Commissioner of Patents and Trademarks*